US010233941B2

(12) United States Patent
Jan et al.

(10) Patent No.: US 10,233,941 B2
(45) Date of Patent: Mar. 19, 2019

(54) PLASTIC VARIABLE INLET GUIDE VANE

(71) Applicant: United Technologies Corporation, Hartford, CT (US)

(72) Inventors: Shihming Jan, Solana Beach, CA (US); Nagendra Narasimha Kedlaya, San Diego, CA (US); Jang Y. Jo, Chula Vista, CA (US); William D. Sherman, Kingston, IL (US); Daniel J. Deen, San Diego, CA (US); Phillip Creed, Tollhouse, CA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 529 days.

(21) Appl. No.: 14/904,469

(22) PCT Filed: Jul. 10, 2014

(86) PCT No.: PCT/US2014/046116

§ 371 (c)(1),
(2) Date: Jan. 12, 2016

(87) PCT Pub. No.: WO2015/006538

PCT Pub. Date: Jan. 15, 2015

(65) Prior Publication Data

US 2016/0169246 A1 Jun. 16, 2016

Related U.S. Application Data

(60) Provisional application No. 61/845,649, filed on Jul. 12, 2013.

(51) Int. Cl.

| | |
|---|---|
| ***F01D 17/16*** | (2006.01) |
| ***F04D 29/56*** | (2006.01) |
| ***F04D 29/02*** | (2006.01) |

(52) U.S. Cl.
CPC ..... *F04D 29/563* (2013.01); *F01D 17/162* (2013.01); *F04D 29/023* (2013.01);
(Continued)

(58) Field of Classification Search
CPC .... F04D 29/563; F04D 29/023; F01D 17/162; F01D 17/167; F01D 25/005;
(Continued)

(56) References Cited

U.S. PATENT DOCUMENTS 2,655,344 A * 10/1953 McDonald ..... E21B 4/02 175/100
2,738,126 A * 3/1956 Edwards ..... F01D 5/066 416/215

(Continued)

FOREIGN PATENT DOCUMENTS

JP 2010249088 A 11/2010
JP 2013019324 A 1/2013

OTHER PUBLICATIONS

Translation—JP 2013-19324.*

(Continued)

*Primary Examiner* — Jason D Shanske
*Assistant Examiner* — Brian Christopher Delrue
(74) *Attorney, Agent, or Firm* — Cantor Colburn LLP

(57) ABSTRACT

The present disclosure relates generally to the field of variable geometry guide vanes for gas turbine engines. More specifically, the present disclosure relates to a plastic variable inlet guide vane for a gas turbine engine.

9 Claims, 5 Drawing Sheets

(52) U.S. Cl.
CPC .... *F05D 2300/43* (2013.01); *F05D 2300/433* (2013.01); *F05D 2300/436* (2013.01); *F05D 2300/603* (2013.01)

(58) Field of Classification Search
CPC ..... F05D 2300/43; F05D 2300/433; F05D 2300/436; F05D 2300/603; F05D 2300/434
USPC ..... 415/160
See application file for complete search history.

(56) References Cited

U.S. PATENT DOCUMENTS

| | | | | |
|---|---|---|---|---|
| 4,741,665 | A | 5/1988 | Hanser | |
| 5,380,152 | A * | 1/1995 | Sikorski | B29D 99/0025 415/160 |
| 5,895,204 | A * | 4/1999 | Sishtla | F04D 29/464 415/148 |
| 6,554,567 | B2 * | 4/2003 | Sishtla | F04D 29/023 415/150 |
| 2003/0059296 | A1 * | 3/2003 | Sishtla | F04D 29/023 415/150 |
| 2003/0110887 | A1 * | 6/2003 | Bartone | B22F 3/22 75/252 |
| 2007/0237631 | A1 | 10/2007 | Lytle | |
| 2008/0298955 | A1 | 12/2008 | Major et al. | |
| 2011/0110783 | A1 | 5/2011 | Addis et al. | |
| 2012/0039731 | A1 * | 2/2012 | Sadi | F04D 29/164 417/423.7 |
| 2013/0259658 | A1 * | 10/2013 | Dube | F01D 5/10 415/148 |
| 2015/0330411 | A1 * | 11/2015 | Heli | F04D 29/542 415/208.2 |
| 2017/0051667 | A1 * | 2/2017 | Godman | F01D 25/28 |

OTHER PUBLICATIONS

Translation—JP 2010-249088.*
International Search Report for International Application No. PCT/US2014/046116.
Written Opinion for International Application No. PCT/US2014/046116.
English Abstract for JP2010-249088.
Database WPI; Week 201311; Thomson Scientific, London GB; AN 2013-B54578; XP-002766694; 1 pg.
European Search Report for Application No. 14823714.2-1607/3019729; dated Feb. 20, 2017; 8 pgs.

* cited by examiner

PLASTIC VARIABLE INLET GUIDE VANE

CROSS REFERENCE TO RELATED APPLICATION

The present application is related to, claims the priority benefit of U.S. Provisional Patent Application Ser. No. 61/845,649, filed Jul. 12, 2013. The contents of this application is hereby incorporated by reference in its entirety into this disclosure.

TECHNICAL FIELD OF THE DISCLOSURE

The present disclosure is generally related to gas turbine engines and, more specifically, to a plastic variable inlet guide vane for a gas turbine engine.

BACKGROUND OF THE DISCLOSURE

A gas turbine engine compressor typically includes inlet guide vanes followed by a row, or stage of compressor rotor blades. During operation, air flows through the inlet guide vane and is sequentially compressed by the compressor stages.

Inlet guide vanes are used to meter the amount of airflow through the compressor. Variable inlet guide vane assemblies use blades that can be individually rotated around their axis, as opposed to the power axis of the engine. The vanes are arranged in an annular duct and are rotated in synchronization to change the open area of the duct, allowing more or less air to pass therethrough.

Vane movement is accomplished by coupling a sector gear on each of the vanes to a common actuation ring gear for providing uniform adjustment of the individual vanes in order to dynamically change their position. Each vane must be identically angled relative to the other vanes in the ring to maximize efficiency and prevent undesirable aerodynamic distortion from a misaligned vane. After some period of use, and under some engine operating conditions, the meshed gears may bind, inhibiting the ability to change the position of the inlet guide vane.

Improvements in variable inlet guide vanes are therefore needed in the art.

SUMMARY OF THE DISCLOSURE

In one embodiment, a variable inlet guide vane for a gas turbine engine is disclosed, the variable inlet guide vane comprising: an airfoil, a first trunnion operatively coupled to the airfoil, and a sector gear operatively coupled to the first trunnion, wherein the airfoil, the first trunnion and the sector gear are all made from plastic.

In another embodiment a gas turbine engine is disclosed, comprising: a plurality of variable inlet guide vanes, each of the variable inlet guide vanes comprising: an airfoil; a first trunnion operatively coupled to the airfoil; a sector gear operatively coupled to the first trunnion; wherein the airfoil, the first trunnion and the sector gear are all made from plastic.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
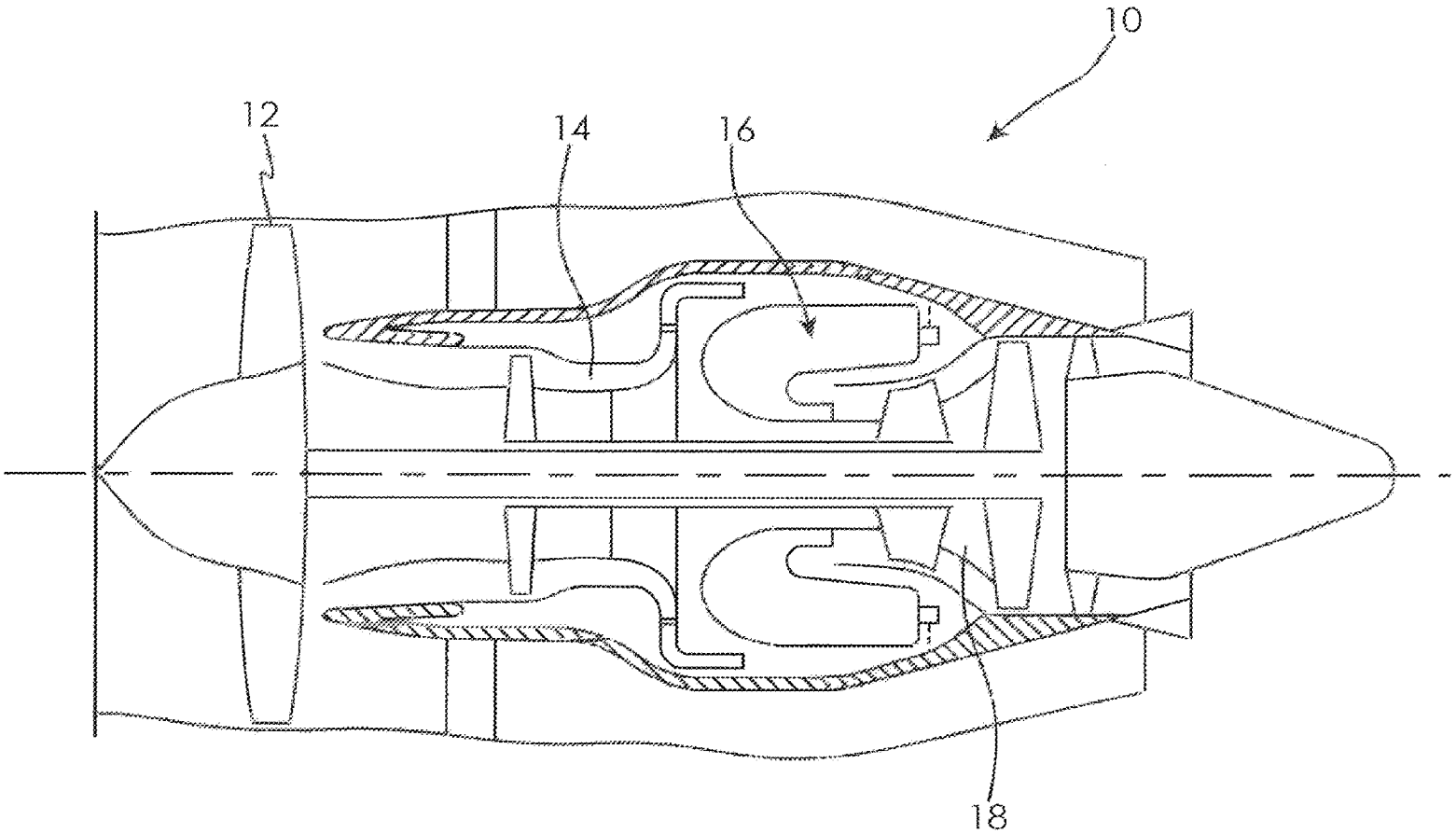
FIG. 1 is a schematic cross-sectional view of a gas turbine engine.

FIG. 1 illustrates a gas turbine engine 10 of a type normally provided for use in generation of electric power and bleed air, generally comprising in serial flow communication a fan 12 through which ambient air is propelled, a compressor section 14 for pressurizing a portion of the air (the gas path air), a combustor 16 in which the compressed air is mixed with fuel and ignited for generating a stream of hot combustion gases, and a turbine section 18 for extracting energy from the combustion gases.

Figure 2:
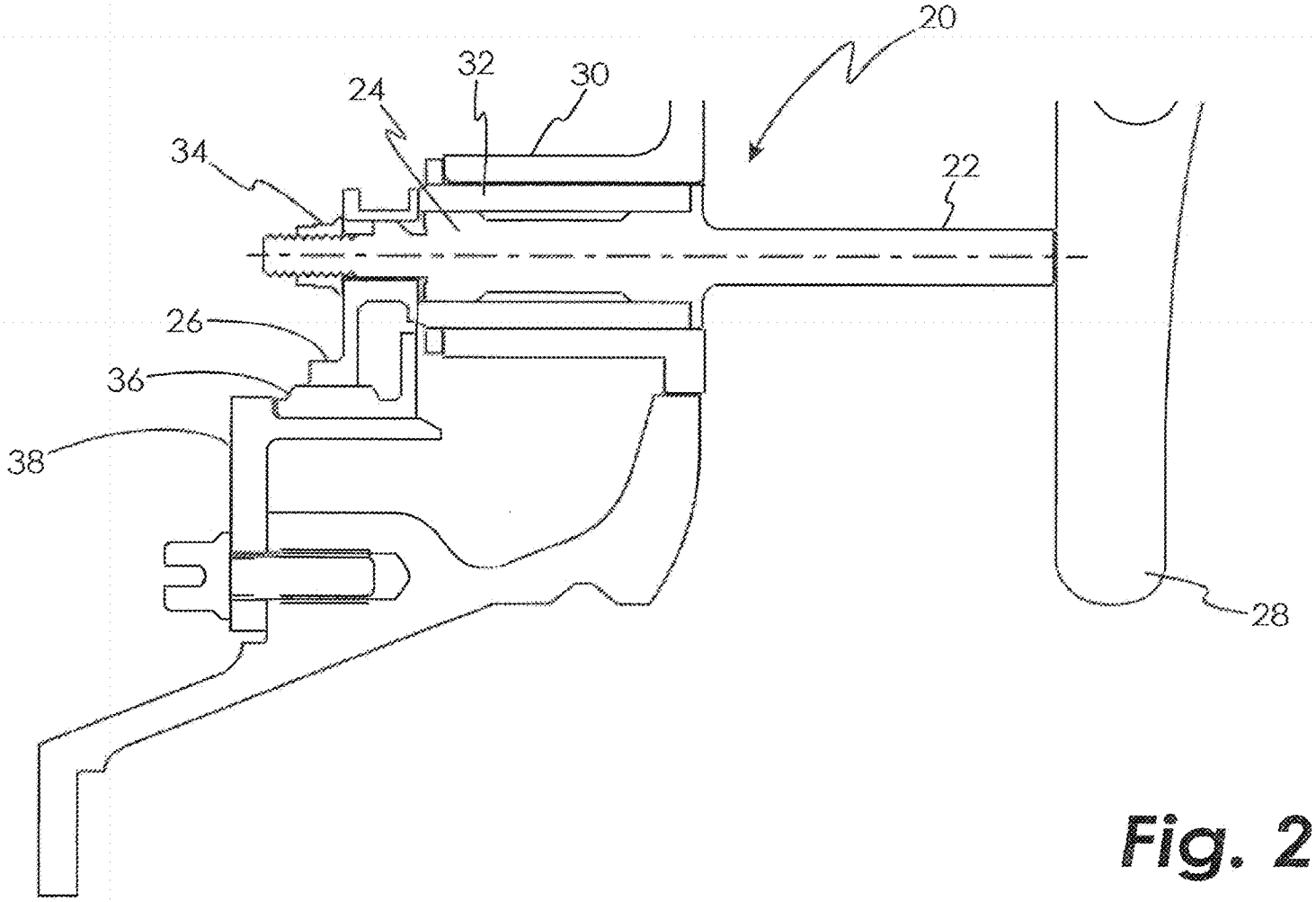
FIG. 2 is a schematic cross-sectional view of a variable inlet guide vane and associated support structure in an embodiment.
Figure 3:
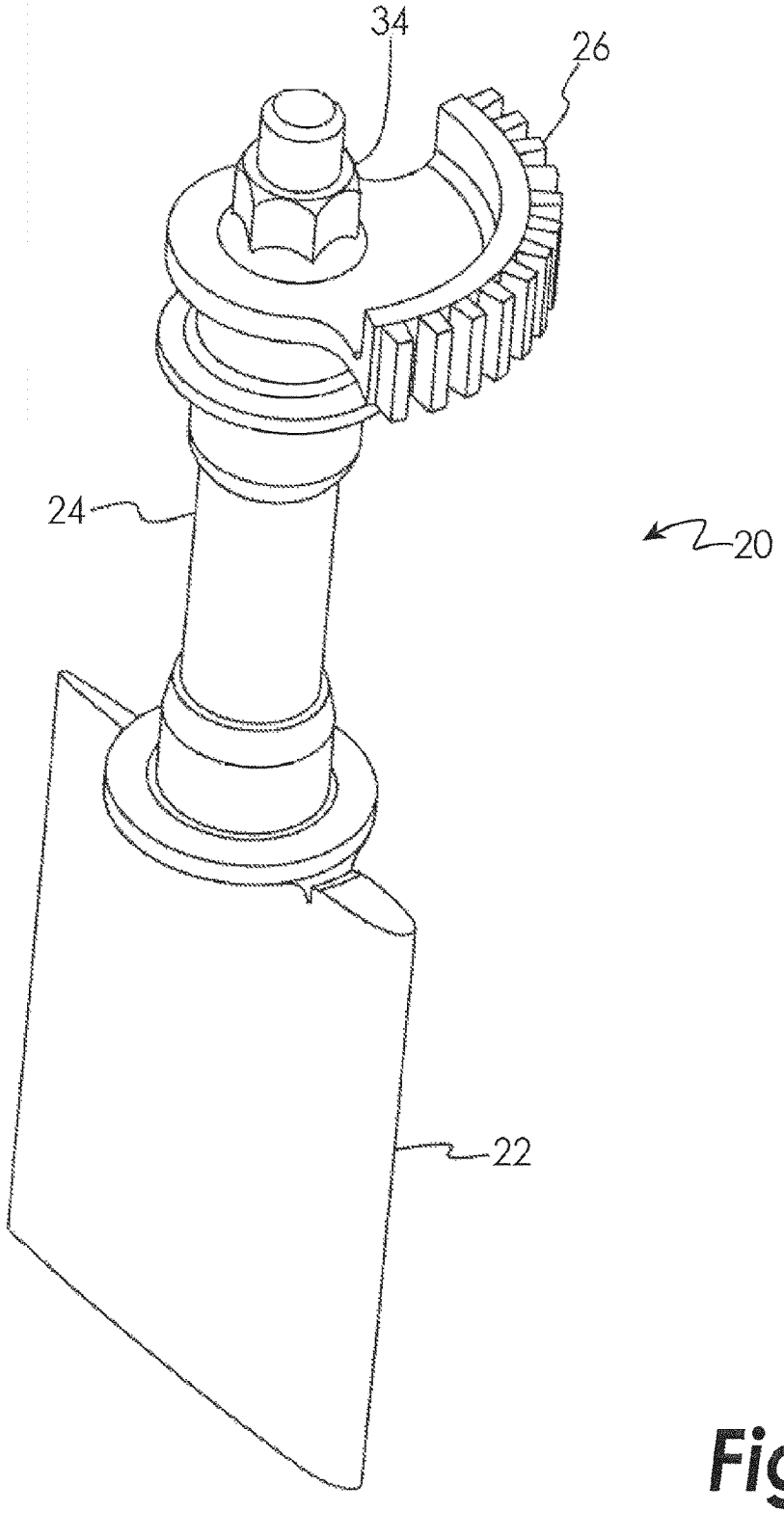
FIG. 3 is a perspective view of a variable inlet guide vane in an embodiment.

FIG. 2 schematically illustrates a variable inlet guide vane 20 and associated support structure in an embodiment. A perspective view of the variable inlet guide vane 20 is illustrated in FIG. 3. The variable inlet guide vane 20 is formed from metal and includes an airfoil 22, a trunnion 24, and a sector gear 26. The trunnion 24 of the variable inlet guide vane 20 is supported within the engine inlet housing 28 by means of a bearing support 30. Because the trunnion 24 and the bearing support 30 are both formed from metal, a bushing 32 is disposed between the trunnion 24 and the bearing support 30 to prevent wear of these components. In an embodiment, the bushing 32 is formed from an amorphous thermoplastic polyetherimide (PEI) resin, however other materials may be used for the bushing.

The sector gear 26 is held in place on the trunnion 24 by means of a nut 34 that mates with a threaded surface formed into the trunnion 24. The sector gear 26 meshes with, and is driven by, a ring gear 36 supported by a support ring 38. An engine will include a plurality of such variable inlet guide vanes 20, each having their own sector gear 26 meshed with the ring gear 36. The ring gear 36 may be rotated, which will cause the sector gear 26 for each of the variable inlet guide vanes 20 to rotate and hence each of the variable inlet guide vanes 20 will simultaneously rotate within their respective bearing supports 30, causing each variable inlet guide vane 20 to change its position by the same amount in order to control air flow to the compressor.

Because both the ring gear 36 and the sector gear 26 are formed from metal, and large loads are placed upon the meshed gear teeth, large levels of friction can occur at the surfaces of the meshed gear teeth, leading to galling of the gear surfaces. Galling is a form of wear caused by adhesion between sliding surfaces. When a material galls, some of it is pulled with the contacting surface, especially if there is a large amount of force compressing the surfaces together, as may be the case with the meshed teeth of the sector gear 26 and the ring gear 36. Galling is caused by a combination of friction and adhesion between the surfaces, followed by slipping and tearing of crystal structure beneath the surface. This will generally leave some material stuck or even friction welded to the adjacent surface, while the galled material may appear gouged with balled-up or torn lumps of material stuck to its surface. This leads to distortion of the gear teeth and leads to degraded performance of the variable inlet guide vane system.

Figure 4:
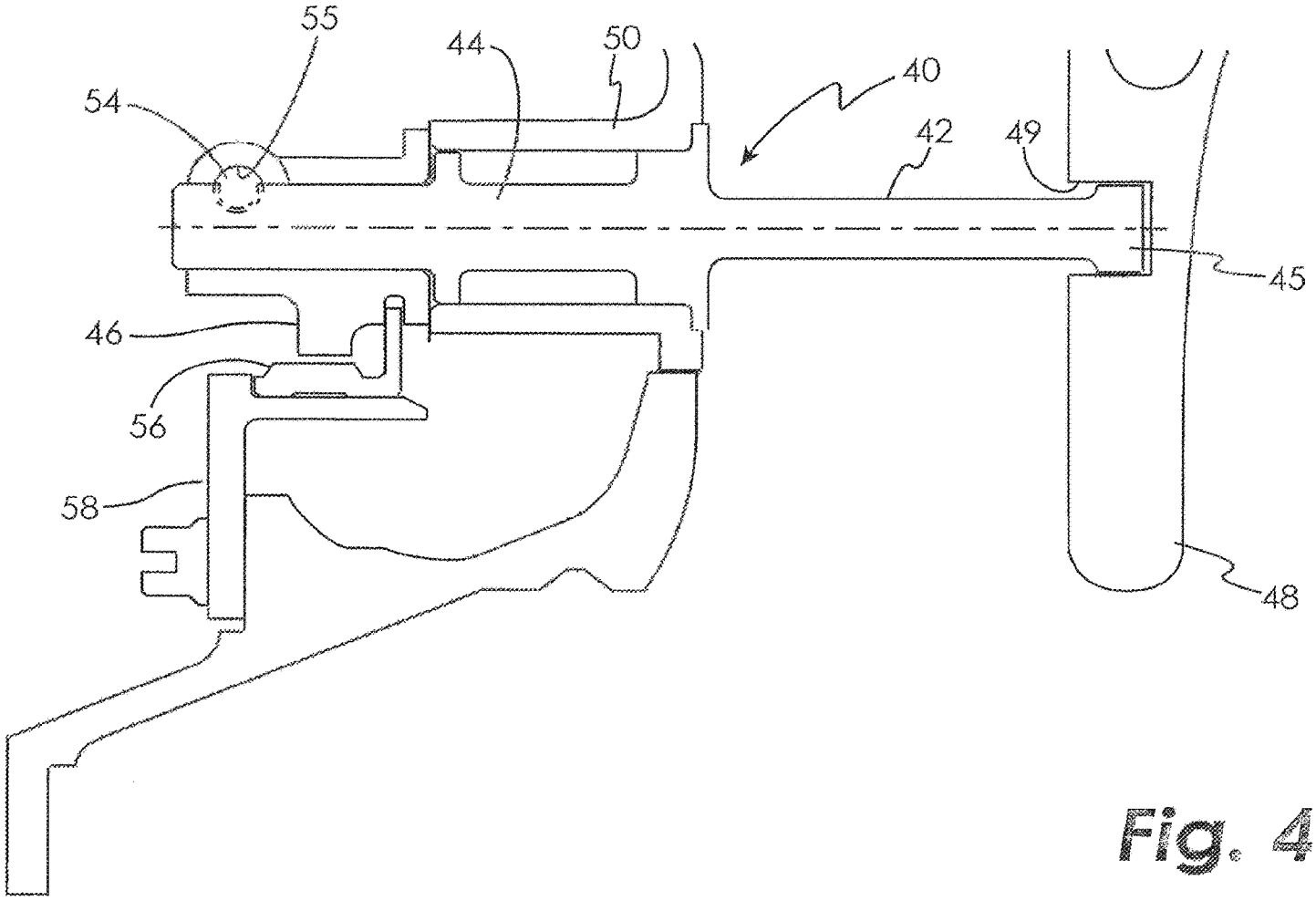
FIG. 4 is a schematic cross-sectional view of a variable inlet guide vane and associated support structure in an embodiment.
Figure 5:
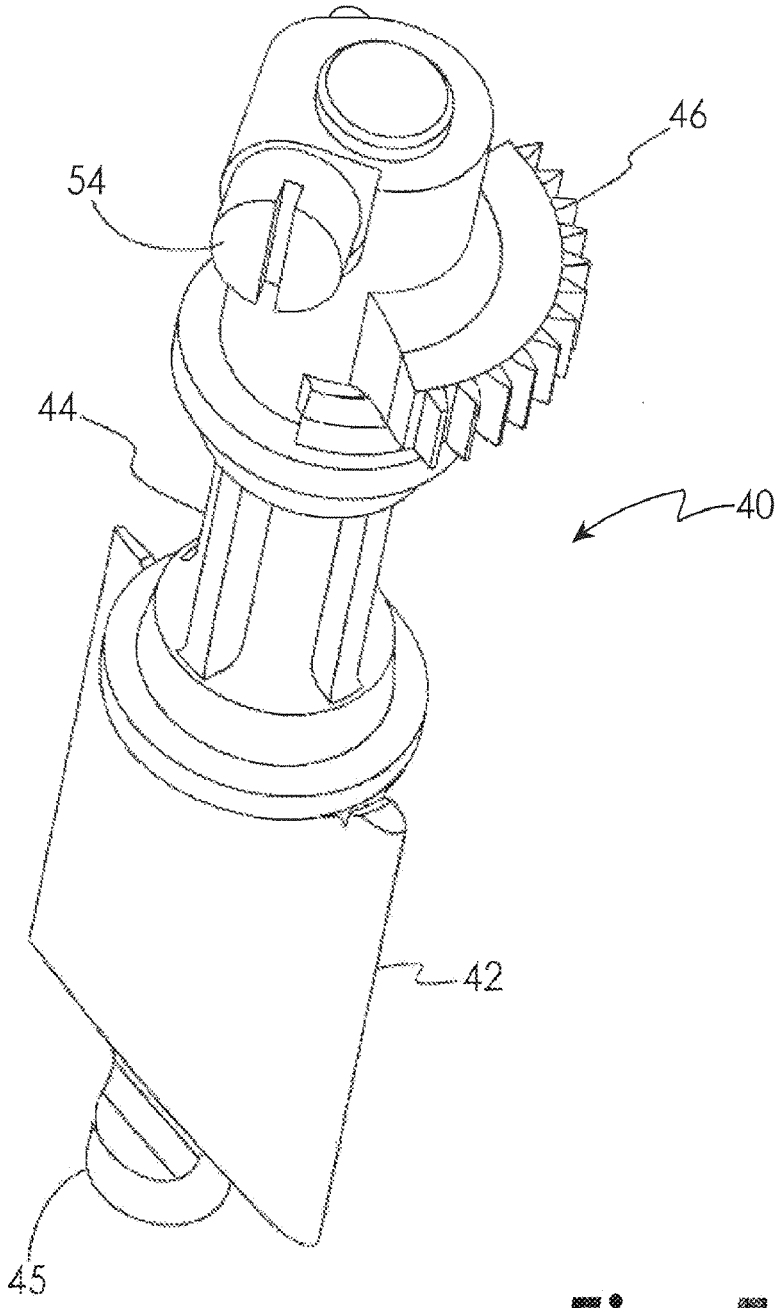
FIG. 5 is a perspective view of a variable inlet guide vane in an embodiment.

FIG. 4 schematically illustrates a variable inlet guide vane 40 and associated support structure in an embodiment. A perspective view of the variable inlet guide vane 40 is illustrated in FIG. 5. The variable inlet guide vane 40 is formed from plastic and includes an airfoil 42, a radially outer trunnion 44, a radially inner trunnion 45, and a sector gear 46. The outer trunnion 44 of the variable inlet guide vane 40 is supported within the engine inlet housing 48 by means of a bearing support 50. Because the variable inlet guide vane 40, including the outer trunnion 44, is made from plastic and the bearing support 50 is formed from metal, no bushing is needed between the variable inlet guide vane 40 and the bearing support 50 to prevent wear of these components. The inner trunnion 45 is received into an opening 49 formed in the inlet housing 48. By resting the inner trunnion 45 in the opening 49, the variable inlet guide vane 40 is further supported.

The sector gear 46 is held in place on the outer trunnion 44 by means of a plastic screw 54 that threadingly engages a passage 55 formed through the sector gear 46 and the outer trunnion 44, in an embodiment. Engagement of the screw 54 against the passage 55 prevents the sector gear 46 from rotating with respect to the outer trunnion 44 under load. It will be appreciated from the present disclosure that other embodiments may use other arrangements to prevent rotation of the sector gear 46 relative to the outer trunnion 44. The sector gear 46 may be formed as a unitary structure with the airfoil 42, outer trunnion 44, and inner trunnion 45 in an embodiment, eliminating the need for the screw 54. In some embodiments, the inner trunnion 45 is eliminated and the variable inlet guide vane 40 is solely supported by the outer trunnion 44.

The sector gear 46 meshes with, and is driven by, a ring gear 56 supported by a support ring 58. An engine will include a plurality of such variable inlet guide vanes 40, each having their own sector gear 46 meshed with the ring gear 56. The ring gear 56 may be rotated and this will cause all of the sector gears 26 to rotate and hence each of the variable inlet guide vanes 40 will simultaneously rotate within their respective bearing supports 50. Each variable inlet guide vane 40 will thereby change its position by the same amount in order to control air flow to the compressor.

The variable inlet guide vane 40 including the airfoil 42, the outer trunnion 44, the inner trunion 45, the sector gear 46, and the screw 54 may be formed from plastic material in an embodiment. The environmental and loading conditions experienced by the variable inlet guide vane 40 will determine what plastic is acceptable, but some embodiments are formed from polyether ether ketone (PEEK), polyamide-imide (PAI), and polyimide resins. In some embodiments, the plastic material comprises a polymer composite having a filler (or fillers) such as carbon fiber, to name just one non-limiting example.

The variable inlet guide vane 40 is formed by injection molding in an embodiment. The variable inlet guide vane 40 is formed by machining extruded or molded stock in another embodiment. The variable inlet guide vane 40 is formed by pressing a powder into the desired shape and then sintering the powder to fuse the material in another embodiment. Any appropriate manufacturing technique may be employed to make the variable inlet guide vane 40. The sector gear 46 and screw 54 may be formed from a different plastic or plastics than the airfoil 42, the outer trunnion 44, and the inner trunnion 45 in an embodiment.

As mentioned above, forming the outer trunnion 44 from plastic allows for elimination of the bushing between the outer trunnion 44 and the bearing support 50. Additionally, the plastic teeth of the sector gear 46 are self-lubricating. The plastic-to-metal sliding friction at the gear teeth interface of the meshed plastic sector gear 46 and metal ring gear 56 is therefore greatly reduced from the friction of the gear teeth interface of the meshed metal sector gear 26 and metal ring gear 36. The plastic teeth of the sector gear 46 will also deform more easily under load than metal teeth and therefore maintain better contact with the meshed teeth of the ring gear 56. Also, if dust or other debris find their way into the meshed gears, it is easier for the plastic gear to slide over the surface and maintain proper contact with the ring gear 56. Additionally, injection molding and other plastic manufacturing technologies allow more effective sector gear 46 tooth profiles to be created compared to very difficult metal machining processes.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed:

1. A variable inlet guide vane system for a gas turbine engine, the variable inlet guide vane system comprising:
- an inlet housing having an opening;
- a metal bearing support;
- a variable inlet guide vane, the variable inlet guide vane comprising:
  - an airfoil;
  - a first trunnion operatively coupled to the airfoil and supported within the inlet housing by the bearing support;
  - a sector gear operatively coupled to the first trunnion, wherein a passage is formed through the first trunnion and the sector gear, and wherein a screw threading engages the passage, holds the sector gear in place against the first trunnion, and prevents the sector gear from rotating relative to the first trunnion;
  - wherein the airfoil, the first trunnion and the sector gear are all made from plastic, and
- wherein no busing is between the variable inlet guide vane and the bearing support.

2. The variable inlet guide vane system of claim 1, wherein the airfoil, the first trunnion, the second trunnion and the sector gear are all formed from the same plastic.

3. The variable inlet guide vane system of claim 1, wherein the airfoil, the first trunnion, the second trunnion and the sector gear are all formed from the same plastic as a unitary injection molded piece.

4. The variable inlet guide vane system of claim 1, wherein the airfoil, the first trunnion, the second trunnion and the sector gear are all made from the same plastic and comprise machined extruded stock.

5. The variable inlet guide vane system of claim 1, wherein the airfoil, the first trunnion, the second trunnion and the sector gear are all made from the same plastic and comprise a sintered powder.

6. The variable inlet guide vane system of claim 1, wherein the plastic comprises a polymer composite.

7. The variable inlet guide vane system of claim 6, wherein the plastic is selected from the group consisting of: polyether ether ketone, polyamide-imide, and polyimide resins.

8. The variable inlet guide vane system of claim 1, wherein the polymer composite includes carbon fiber.

9. A gas turbine engine comprising:

the variable inlet guide vane system of claim 1, the system comprising a plurality of the variable inlet guide vanes.

* * * * *